US008474669B2

(12) United States Patent
Rohrbach et al.

(10) Patent No.: US 8,474,669 B2
(45) Date of Patent: Jul. 2, 2013

(54) ARMBAND FOR HOLDING AN ELECTRONIC DEVICE

(75) Inventors: Matthew Dean Rohrbach, San Francisco, CA (US); Jonathan Ive, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 1413 days.

(21) Appl. No.: 11/849,808

(22) Filed: Sep. 4, 2007

(65) Prior Publication Data

US 2009/0057357 A1 Mar. 5, 2009

(51) Int. Cl.
*A45C 11/00* (2006.01)
*A45F 5/00* (2006.01)

(52) U.S. Cl.
USPC ..... 224/222; 224/267; 224/930; 224/901.4

(58) Field of Classification Search
USPC ..... 224/901.4, 267, 930, 178, 218–222
See application file for complete search history.

(56) References Cited

U.S. PATENT DOCUMENTS 4,500,019 A * 2/1985 Curley, Jr. ..... 224/222
4,530,873 A * 7/1985 Okada ..... 442/79
4,939,818 A * 7/1990 Hahn ..... 24/16 R
5,766,387 A * 6/1998 Wolf et al. ..... 156/62.4
5,935,878 A * 8/1999 Glasser ..... 442/30
6,629,628 B1 * 10/2003 Canepari et al. ..... 224/222
D529,280 S * 10/2006 Krieger et al. ..... D3/218
D541,042 S * 4/2007 Andre et al. ..... D3/218
D599,108 S * 9/2009 Brandenburg ..... D3/218
2006/0175370 A1 * 8/2006 Arney et al. ..... 224/666
2006/0186150 A1 * 8/2006 Willows et al. ..... 224/222
2007/0215663 A1 * 9/2007 Chongson et al. ..... 224/930
2009/0020570 A1 * 1/2009 Chan ..... 224/222

* cited by examiner

*Primary Examiner* — Justin Larson
*Assistant Examiner* — Corey Skurdal
(74) *Attorney, Agent, or Firm* — Womble Carlyle Sandridge & Rice LLP

(57) ABSTRACT

An armband that holds an electronic device is presented. The armband includes a pouch which includes a window and an opening configured to allow an electronic device to be inserted into the pouch. The armband also includes an arm strap wherein the proximate end of the arm strap is coupled to the pouch, and wherein the arm strap includes: holes arranged in a specified pattern; loop cells at specified locations along the length of the arm strap; and a hook cell located at a distal end of the arm strap. The armband further includes a ring coupled to the pouch configured to allow the distal end of the arm strap to be passed through the ring and pulled toward the proximate end of the arm strap so that the hook cell can be coupled to one or more loop cells.

29 Claims, 7 Drawing Sheets

ARMBAND FOR HOLDING AN ELECTRONIC DEVICE

BACKGROUND

1. Field of the Invention

The present invention relates to an armband which is configured to hold an electronic device.

2. Related Art

Electronic devices such as portable music players, cell phones, and personal digital assistants (PDAs) are used every day by millions of people. Though electronic devices are becoming smaller, carrying these electronic devices may still present a problem. For example, PDAs and hybrid PDA-cell phone devices are typically large and cumbersome to place in a pocket. Similarly, carrying and using a portable music player while exercising can be a challenge.

Existing techniques for carrying these electronic devices involve using: belt clips, necklace cases, and armbands. Belt clips are typically used for larger devices such as PDAs and hybrid PDA-cell phone devices. However, these belt clips can be bulky and cumbersome to use. Necklace cases can be used for smaller electronic devices such as portable music player, but are not practical for larger electronic devices. Armbands are typically used to carry portable music players while exercising. However, existing armbands have a number of disadvantages. More specifically, existing armbands are relatively large, do not let skin breathe through the armband, do not stretch, and become brittle as the armband ages.

Hence, what is needed is an apparatus to carry electronic devices without the problems described above.

SUMMARY

Some embodiments of the present invention provide an armband that holds an electronic device. This armband includes a pouch with a first face and a second face; a window on the first face of the pouch; and an opening located along a first edge of the second face of the pouch, wherein the opening is configured to allow an electronic device to be inserted into the pouch. The armband also includes an arm strap, wherein a proximate end of the arm strap is coupled to a second edge of the pouch, and wherein the arm strap includes: a plurality of holes arranged in a specified pattern; a plurality of loop cells at specified locations along the length of the arm strap; and a hook cell located at a distal end of the arm strap. The armband further includes a ring coupled to a third edge of the pouch, wherein the ring is configured to allow the distal end of the arm strap to be passed through the ring and pulled toward the proximate end of the arm strap so that the hook cell can be coupled to one or more loop cells, thereby securing the armband to an arm.

In some embodiments, the armband includes a device-securing strap coupled to the pouch, wherein the device-securing strap is configured to prevent the electronic device from slipping out of the opening of the pouch.

In some embodiments, the armband includes a closure hook cell located on the device-securing strap.

In some embodiments, the armband includes one or more closure cells located on the second face of the pouch, wherein the closure hook cell located on the device-securing strap is configured to couple to a closure cell on the second face of the pouch.

In some embodiments, the one or more closure cells are located so that the pouch can accommodate electronic devices of different sizes.

In some embodiments, the third edge is located opposite of the second edge.

In some embodiments, the specified pattern for the plurality of holes on the arm strap is configured to balance between stretchability and breathability of the arm strap.

In some embodiments, the specified pattern for the plurality of holes includes one or more of rows of holes, wherein holes in a given row are offset a specified distance from a centerline of holes in an adjacent row.

In some embodiments, the specified distance is one-half the distance between a pair of holes in the adjacent row of holes.

In some embodiments, adjacent holes in a row of holes are substantially equally spaced.

In some embodiments, adjacent holes in a row are spaced 6.7 millimeters apart as measured from a centerline of the adjacent holes.

In some embodiments, adjacent rows of holes are substantially equally spaced.

In some embodiments, adjacent rows of holes are spaced between 3.8 millimeters and 4 millimeters apart inclusive as measured from the centerlines of adjacent rows of holes.

In some embodiments, the diameters of the holes are substantially the same.

In some embodiments, the diameter of the holes is between 1.5 millimeters and 3.5 millimeters inclusive.

In some embodiments, the loop cells are oval.

In some embodiments, the loops cells are located on the arm strap so that the hook cell can overlap at least two adjacent loop cells.

In some embodiments, the window is bonded to the pouch using an adhesive, heat, and pressure.

In some embodiments, the window includes: a substantially transparent portion; and a substantially translucent portion.

In some embodiments, the substantially translucent portion of the window is formed by applying an ink to a portion of an outer surface of the window.

In some embodiments, the ink is formulated so that the ink provides: a frosty and translucent appearance; and a low-friction scrolling surface for a finger.

In some embodiments, the window includes a button area which is configured to facilitate locating a button on the electronic device.

In some embodiments, the button area is located within the translucent portion of the window.

In some embodiments, the button area protrudes out-of-plane from the outer surface of the window.

In some embodiments, the button area is formed using a hydroforming process which presses the window into a desired shape.

In some embodiments, the button area is formed after ink is applied to the window.

In some embodiments, the arm strap comprises a layer of spandex sandwiched between two layers of polyurethane.

In some embodiments, the polyurethane-spandex-polyurethane sandwich is resistant to fraying.

In some embodiments, the armband includes a polyurethane microfiber material for an inner lining of the pouch.

In some embodiments, the arm strap and the first face of the pouch are made from a single piece of material.

In some embodiments, the first face of the pouch and a second face of the pouch are bonded together along the edges of the pouch.

In some embodiments, a bond is created using an adhesive, heat, and pressure applied at the edges of the pouch.

In some embodiments, the adhesive is a urethane-based adhesive.

In some embodiments, a hole is cut into the second face of the pouch to create the opening in the pouch, wherein the hole is located away from the edge of the second face.

In some embodiments, the armband includes stitches at a junction of the arm strap and the pouch to reinforce the coupling between the arm strap and the pouch.

In some embodiments, the armband includes stitches at a junction of the ring and the pouch to reinforce the coupling between the ring and the pouch.

In some embodiments, the armband includes a storage-mode cell located on a face of the arm strap opposite to the face of the arm strap in which the plurality of loop cells and the hook cell are located, wherein the storage-mode cell is configured so that when the arm strap is wrapped around the pouch, the hook cell can be coupled to the storage-mode cell.

In some embodiments, the holes are punched into the arm strap after the loop cells are coupled to the arm strap.

In some embodiments, the electronic device can include: a music player; a mobile phone; and any other mobile electronic device.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1A:
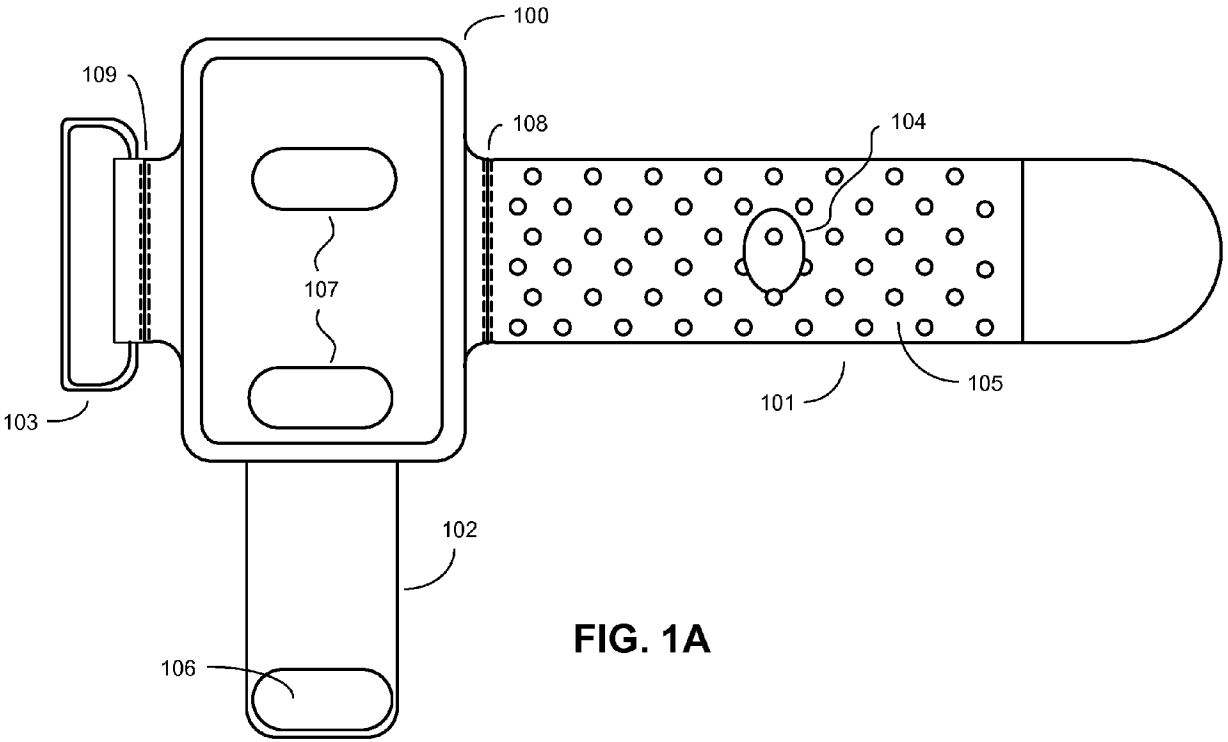
FIG. 1A presents a back view of an armband in accordance with an embodiment of the present invention.
Figure 1B:
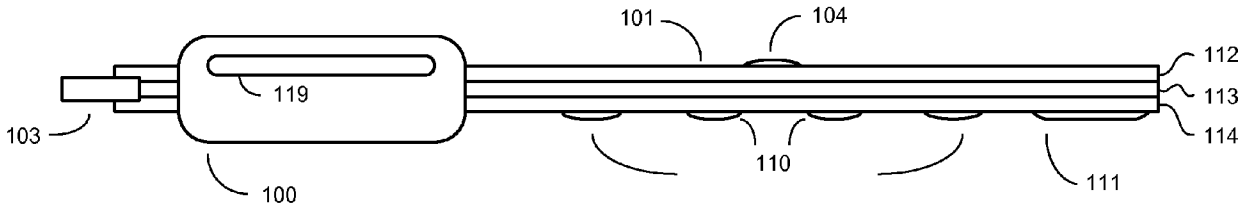
FIG. 1B presents a cross-sectional view of an armband in accordance with an embodiment of the present invention.
Figure 1C:
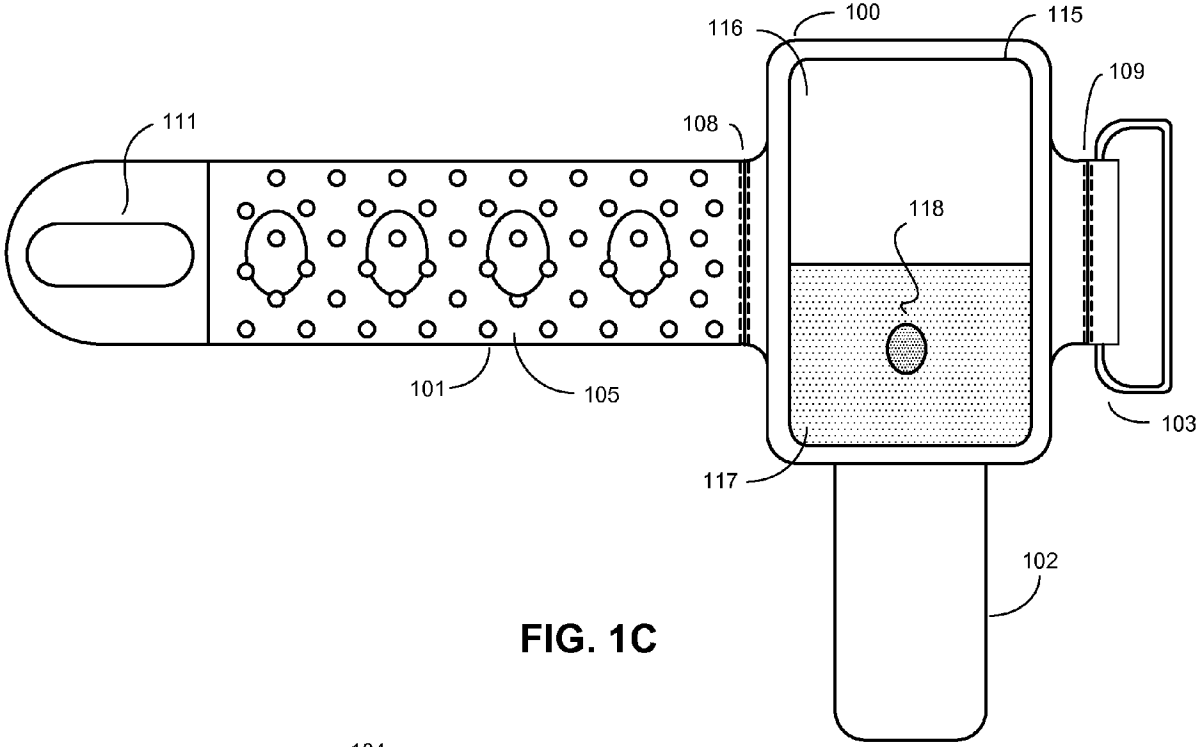
FIG. 1C presents a front view of an armband in accordance with an embodiment of the present invention.
Figure 1D:
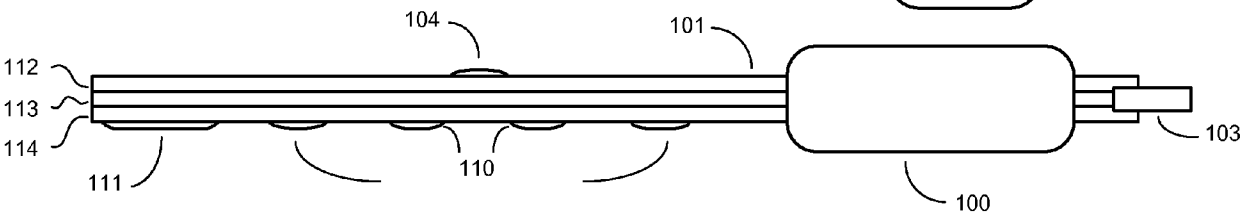
FIG. 1D presents another cross-sectional view of an armband in accordance with an embodiment of the present invention.

FIGS. 1A-1D present a number of views of an armband in accordance with an embodiment of the present invention. More specifically, FIG. 1A presents a back view of an armband in accordance with an embodiment of the present invention; FIG. 1B presents a cross-sectional view of an armband in accordance with an embodiment of the present invention; FIG. 1C presents a front view of an armband in accordance with an embodiment of the present invention; and FIG. 1D presents another cross-sectional view of an armband in accordance with an embodiment of the present invention.

The armband illustrated in FIGS. 1A-1D includes pouch 100. In some embodiments, pouch 100 includes opening 119 along one edge of pouch 100 which can be used to insert an electronic device into pouch 100. The electronic device can include, but is not limited to: a music player; a mobile phone; and any other mobile electronic device. In some embodiments, the inner lining of pouch 100 is made from a polyurethane microfiber material.

Figure 3B:
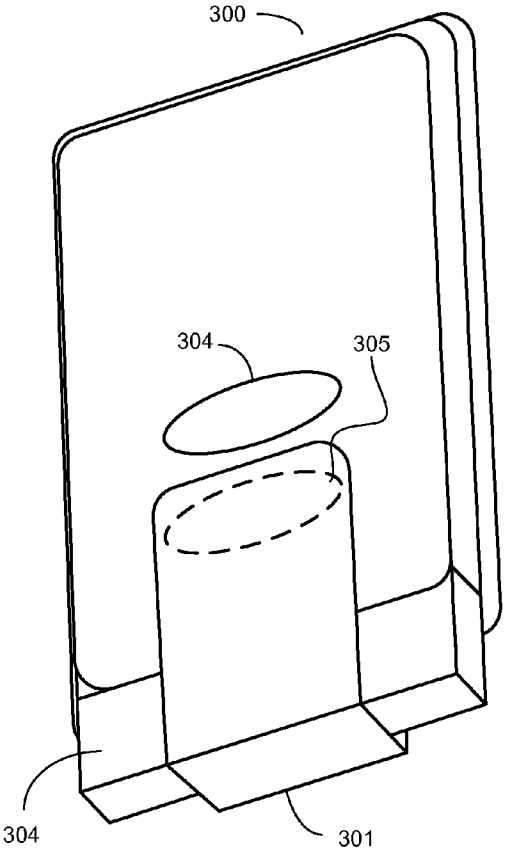
FIG. 3B presents back view of a pouch for an armband which is holding a larger electronic device with an attachment in accordance with an embodiment of the present invention.
Figure 3A:
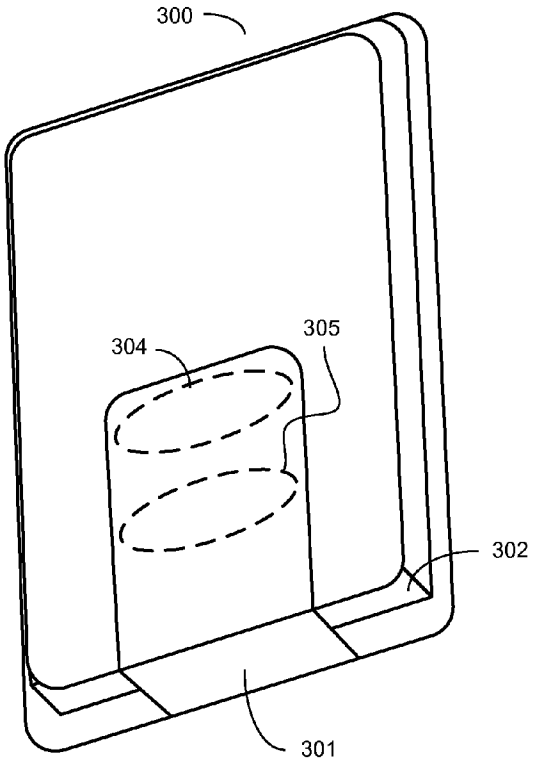
FIG. 3A presents back view of a pouch for an armband which is holding an electronic device in accordance with an embodiment of the present invention.

In some embodiments, pouch 100 is coupled to device-securing strap 102, which includes closure hook cell 106. Furthermore, one or more closure cells 107 are coupled to a back face of pouch 100. Note that although FIG. 1A illustrates two closure cells, any number of closure cells can be used depending on the application. Furthermore, the configuration of the closure cells can be adjusted according to a specified application (e.g., to accommodate electronic devices of varying sizes or a device that may or may not have an attached dongle). Closure hook cell 106 is configured so that device-securing strap 102 can be folded over the opening of the pouch and closure hook cell 106 can be coupled to one or more closure cells 107. The operation of device-securing strap 102 is illustrated in FIGS. 3A and 3B.

Arm strap 101 is coupled to pouch 100. In some embodiments, arm strap 101 is coupled to pouch 100 using stitches 108. Stitches 108 provide mechanical coupling strength between arm strap 101 and pouch 100.

In some embodiments, arm strap 101 includes one or more of: a plurality of holes 105, storage-mode cell 104, loop cells 110, and hook cell 111. Note that the number of loop cells is not limited to four loop cells and can generally be any number of loop cells depending on the application. In some embodiments, the plurality of holes 105 is punched through arm strap 101. The plurality of holes 105 can be configured in a specified pattern to achieve a desired property of arm strap 101. For example, the specified pattern can be chosen to balance between stretchability and breathability of arm strap 101. In some embodiments, the diameters of the holes are substantially the same. In some embodiments, diameter of the holes is between 1.5 millimeters and 3.5 millimeters inclusive.

Note that the various cells used in the present invention can be Velcro® cells or any other type of fasteners. For example, loop cells 110, storage-mode cell 104 and closure cells 107 can be fuzzy Velcro® cells, and hook cell 111 and closure hook cell 106 can be hook Velcro cells.

In some embodiments, the specified pattern for the plurality of holes includes one or more of rows of holes wherein holes in a given row are offset a specified distance from a centerline of holes in an adjacent row. In some embodiments, the specified distance is one-half the distance between a pair of holes in the adjacent row of holes. Adjacent holes can be equally spaced from each other or spaced so that the distance between adjacent holes follows a specified pattern. In some embodiments, adjacent holes within a row are spaced 6.7 millimeters as measured from a centerline of the adjacent holes.

In some embodiments, adjacent rows of holes are substantially equally spaced. In some embodiments, adjacent rows of holes are spaced between 3.8 millimeters and 4 millimeters inclusive as measured from the centerlines of adjacent rows of holes.

Figure 6:
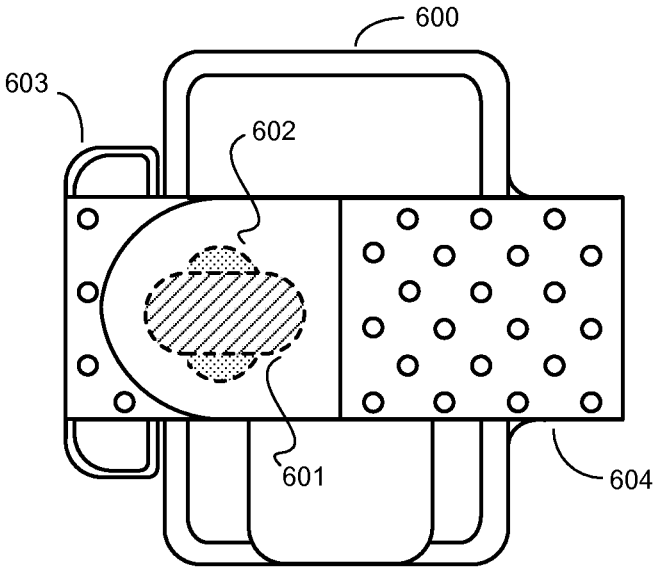
FIG. 6 presents a view of the armband when the arm strap is wrapped around the pouch so that a hook cell on the arm strap is coupled to a storage-mode cell on the arm strap in accordance with an embodiment of the present invention.

In some embodiments, storage-mode cell 104 is configured so that when the arm strap is wrapped around the pouch, hook cell 111 can be coupled to the storage-mode cell. These embodiments allow the arm strap to be secured so that hook cell 111 does not inadvertently attach to other materials (e.g., clothing) while the armband is placed in storage (e.g., in a drawer, in a gym bag, etc.). The operation of storage-mode cell 104 is illustrated in FIG. 6.

Figure 4A:
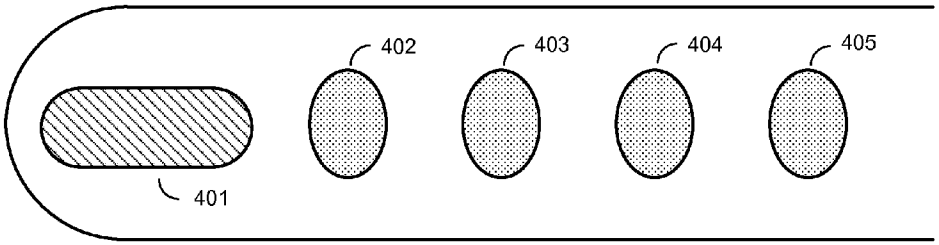
FIG. 4A presents a view of an arm strap for the armband in accordance with an embodiment of the present invention.
Figure 4B:
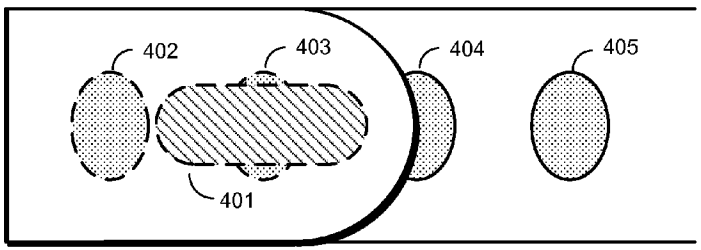
FIG. 4B presents a view of an arm strap for the armband wherein a hook cell is coupled to a loop cell in accordance with an embodiment of the present invention.
Figure 4C:
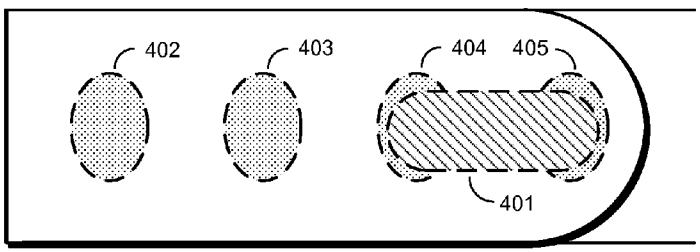
FIG. 4C presents a view of an arm strap for the armband wherein a hook cell is coupled to two loop cells in accordance with an embodiment of the present invention.

In some embodiments, loops cells 110 are located on the arm strap so that hook cell 111 can overlap at least two adjacent loop cells. Note that in these embodiments, hook cell 111 may be able to overlap a single loop cell, but is more likely to overlap two adjacent loop cells. The operation of loop cells 110 and hook cell 111 is illustrated in FIGS. 4A-4C. Also note that the shapes of closure cells 107, closure hook cell 106, loop cells 110, and hook cell 111 are illustrated as ovals. However, these cells can be any shape depending on the application. For example, oval loop cells (and oval storage-mode cell) oriented so that the longer dimension of the oval is substantially aligned with the shorter dimension of arm strap 101 (as illustrated in FIGS. 1A and 1C) allow for more stretch in the lateral direction as compared to circular cells or oval cells oriented in a different direction.

Figure 5A:
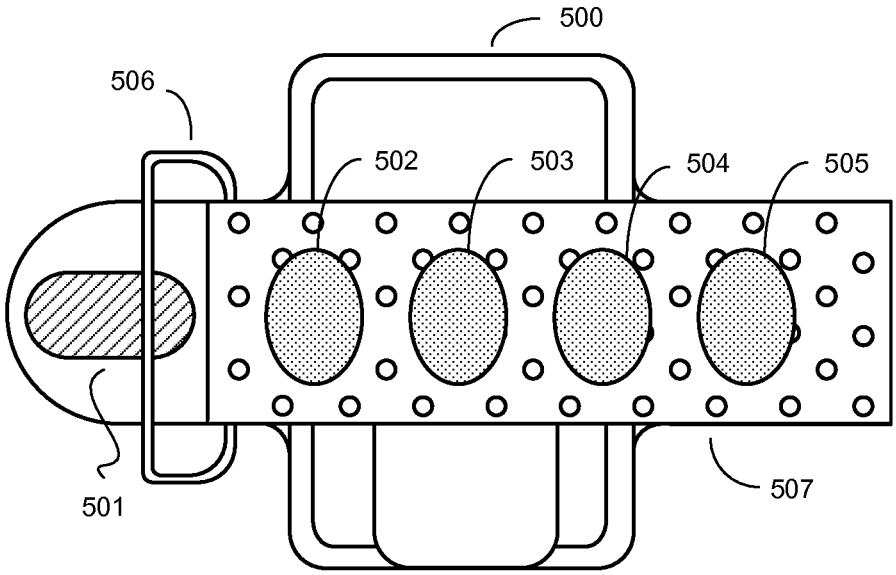
FIG. 5A presents a view of an arm strap inserted into a ring in accordance with an embodiment of the present invention.
Figure 5B:
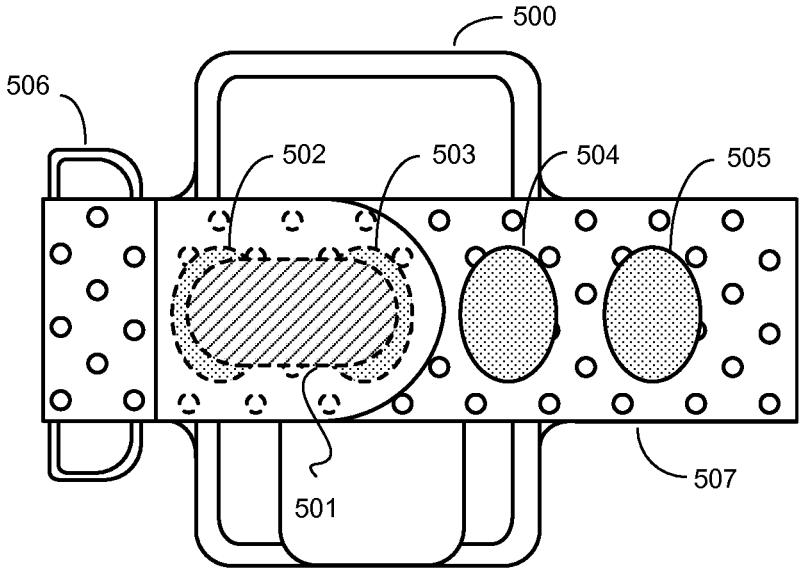
FIG. 5B presents a view of a hook cell on an arm strap secured to a loop cell on the arm strap in accordance with an embodiment of the present invention.

In some embodiments, ring 103 is coupled to pouch 100. In some embodiments, ring 103 is coupled to pouch 100 using stitches 109. Stitches 109 provide mechanical coupling strength between ring 103 and pouch 100. Ring 103 is configured to allow arm strap 101 to be passed through ring 103 and pulled back across arm strap 101 so that hook cell 111 can be coupled to one or more loop cells 110, thereby securing the armband to an arm. The operation of ring 103 is illustrated in FIGS. 5A-5B.

In some embodiments, pouch 100 includes window 115. Window 115 can be bonded to the pouch using an adhesive, heat, and pressure. In some embodiments, window 115 includes a substantially transparent portion 116 and a substantially translucent portion 117. In some embodiments, substantially translucent portion 117 is formed by applying an ink to a portion of an outer surface of the window. The ink can be formulated so that that the ink provides one or more of: a frosty and translucent appearance; and a low-friction scrolling surface for a finger. Note that other processes can be used to create translucent portion 117.

In some embodiments, window 115 includes button area 118, which is configured to facilitate locating a button on the electronic device within the pouch. Furthermore, button area 118 can protrude out-of-plane from the outer surface of the window to facilitate locating button area 118. Note that all of button area 118 or a portion of button area 118 can protrude out-of-plane from the outer surface of the window. Alternatively, button area 118 can be co-planar with the outer surface of the window. Button area 118 can be formed using a hydroforming process which presses the window into a desired shape. Note that other shape-forming processes can be used. In some embodiments, button area 118 is formed after ink is applied to window 115. In some embodiments, button area 118 is within translucent portion 117.

In some embodiments, arm strap 101 can include three layers 112-114. In some embodiments, layers 112 and 114 are made of polyurethane and layer 113 is made of spandex. The polyurethane-spandex-polyurethane layer provides several advantages including, but not limited to: allowing arm strap 101 to stretch but not so far that it will break; not drying out and becoming brittle over time; allowing arm strap 101 to be made thinner than alternatives (e.g., neoprene); the coefficient of thermal expansion is comparable to the other material used in the armband; and the layer is edge stable (e.g., resistant to fraying) so that after die cutting the shape of arm strap 101, the edges of arm strap 101 do not need to be refinished (e.g., sewn, etc.)

In some embodiments, the arm strap and the front face of pouch 100 are made form a single piece of polyurethane-spandex-polyurethane material. In these embodiments, the front face of pouch 100 is bonded to the back face of pouch 100 along the edges of the pouch. In some embodiments, the bond is created using adhesive, heat, and pressure applied at the edges of the pouch. Note by using this bonding process, stitches are not required to couple the front face of pouch 100 with the back face of pouch 100. In one embodiment, the adhesive is a urethane-based adhesive. After the front face and the back face of pouch 100 are bonded together, a hole is cut into the back face of pouch 100 to create the opening in the pouch.

Figure 2A:
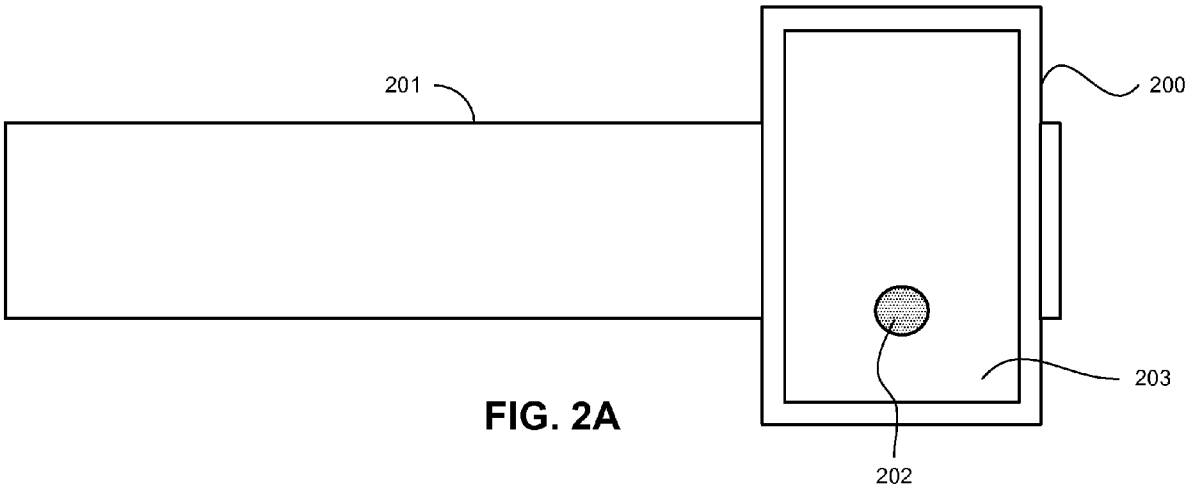
FIG. 2A presents a view of an armband in accordance with an embodiment of the present invention.

FIG. 2A presents a view of an armband in accordance with an embodiment of the present invention. The armband includes pouch 200 and arm strap 201. In some embodiments, pouch 200 has window 203. In some embodiments, window 203 includes button area 202.

Figure 2B:
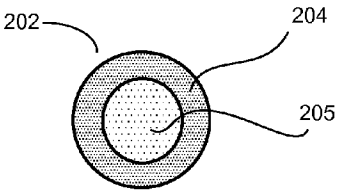
FIG. 2B presents a top view of a button area in accordance with an embodiment of the present invention.

FIG. 2B presents a top view of button area 202 in accordance with an embodiment of the present invention. In some embodiments, a portion of button area 202 protrudes out-of-plane from window 203. In other embodiments, all of button area 202 protrudes out-of-plane from window 203. In other embodiments, button area 202 is co-planar with the surface of window 203.

Although button area 202 is illustrated as a circle, button area 202 can be any shape. For example, button area 202 can be an oval, a square, a rectangle, a diamond, or any other shape. Furthermore, the shape of button area 202 can be chosen based on a specified application (e.g., the shape can substantially match the shape of a button on the electronic device).

Figure 2C:
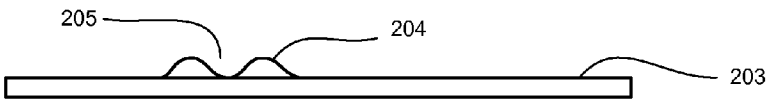
FIG. 2C presents a side view of a button area in accordance with an embodiment of the present invention.

In one embodiment, button area 202 can include inner button area 205 and outer button area 204. In this embodiment, inner button area 205 and outer button area 204 are not co-planar. Instead, outer button area 204 can protrude out of the surface of window 203 more than inner button area 205 protrudes out of the surface of window 203. FIG. 2C presents a side view of button area 202 illustrating this embodiment.

In some embodiments, window 203 includes one or more button areas. For example, window 203 can include a button which is a center button and other buttons which are located around the center button. Note that the center button is not necessarily located at the center of window 203. In some embodiments, one or more detents are located on window 203 to facilitate guiding a finger of a user from the center button to the other buttons. In these embodiments, the one or more button areas can be the same sizes and shapes, can be different sizes and shapes, or can include one or more subsets of button areas with same sizes and/or shapes.

FIG. 3A presents back view of a pouch 300 for an armband which is holding electronic device 302 in accordance with an embodiment of the present invention. (Note that in FIGS. 3A-3B, the arm strap is not shown for the sake of clarity.) As illustrated in FIG. 3A, a hook cell (not shown) is coupled to closure cell 304 so that electronic device 302 is secured within pouch 300. Note that closure cells 304-305 are coupled to pouch 300 whereas the hook cell is coupled to device-securing strap 301.

FIG. 3B presents back view of a pouch 300 for the armband which is holding electronic device with attachment 304 in accordance with an embodiment of the present invention. As illustrated in FIG. 3B, the hook cell (not shown) is coupled to closure cell 305 so that electronic device 304 is secured within pouch 300. Note that a larger electronic device such as electronic device with attachment 304 may protrude from pouch 300. Hence, to accommodate the extra size of electronic device with attachment 304, the hook cell is coupled to closure cell 305 instead of closure cell 304. Also note that there can be any number of closure cells depending on the application.

FIGS. 4A-4C present exemplary views of the coupling of a hook cell with one or more loop cells. FIG. 4A presents a view arm strap 400 for an armband in accordance with an embodiment of the present invention. Arm strap 400 includes hook cell 401 and loop cells 402-405. FIG. 4B presents a view arm strap 400 wherein arm strap 400 is folded over itself so that hook cell 401 is coupled to loop cell 403 in accordance with an embodiment of the present invention. FIG. 4C presents a view arm strap 400 wherein arm strap 400 is folded over itself so that hook cell 401 is coupled to loop cells 404-405 in accordance with an embodiment of the present invention. Note that the cell configurations in FIGS. 4A-4C are used to illustrate the operation of hook cell 401 and loop cells 402-405 and are not meant to limit the scope of the present invention to these cell configurations.

FIGS. 5A-5B illustrate an exemplary process of using an arm strap to secure the armband around an arm in accordance with an embodiment of the present invention. As illustrated in FIGS. 5A-5B, the back side of pouch 500 can be seen. Arm strap 507 and ring 506 are coupled to pouch 500. Furthermore, arm strap 507 includes hook cell 501 and loop cells 502-505. In order to secure the armband around an arm (or another object), the back face of pouch 500 is placed against the arm (not shown). Next, arm strap 507 is pulled round the arm and inserted into ring 506 (see FIG. 5A). Arm strap 507 is then pulled back toward loop cells 502-505 so that hook cell 501 can be coupled to one or more loop cells 502-505. As illustrated in FIG. 5B, hook cell 501 is coupled to loop cells 502-503. Note that hook cell 501 can be coupled to any loop cell depending on the size of the arm that the armband is to be attached.

FIG. 6 presents a view of the armband when arm strap 604 is wrapped around pouch 600 so that hook cell 601 is coupled to storage-mode cell 602 in accordance with an embodiment of the present invention. In doing so, the armband can be stored so that hook cell 601 will not contact and couple to any other materials (e.g., clothing).

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. An armband for holding an electronic device, comprising:

a pouch with a first face and a second face;

a window on the first face of the pouch;

an opening located along a first edge of the second face of the pouch, wherein the opening is configured to allow an electronic device to be inserted into the pouch;

an arm strap having a proximate end coupled to a second edge of the pouch, wherein the arm strap comprises a layer of spandex sandwiched between two layers of polyurethane, and wherein the arm strap further comprises:

a plurality of holes arranged in a specified pattern;

a plurality of loop cells at specified locations along the length of the arm strap; and a hook cell located at a distal end of the arm strap; and a ring coupled to a third edge of the pouch, wherein the ring is configured to allow the distal end of the arm strap to be passed through the ring and pulled toward the proximate end of the arm strap so that the hook cell can be coupled to one or more loop cells.

2. The armband of claim 1, further comprising a device-securing strap coupled to the pouch, wherein the device-securing strap is configured to prevent the electronic device from slipping out of the opening of the pouch.

3. The armband of claim 2, further comprising:

a closure hook cell located on the device-securing strap; and one or more closure cells located on the second face of the pouch, wherein the closure hook cell located on the device-securing strap is configured to couple to a closure cell on the second face of the pouch, wherein the one or more closure cells are located so that the pouch can accommodate electronic devices of different sizes.

4. The armband of claim 1, wherein the third edge is located opposite of the second edge.

5. The armband of claim 1, wherein the specified pattern for the plurality of holes on the arm strap is configured to balance between stretchability and breathability of the arm strap.

6. The armband of claim 1, wherein the specified pattern for the plurality of holes includes one or more of rows of holes;

wherein holes in a given row are offset a specified distance from a centerline of holes in an adjacent row;

wherein the specified distance is one-half the distance between a pair of holes in the adjacent row of holes;

wherein adjacent holes in a row of holes are substantially equally spaced;

wherein adjacent holes in a row are spaced 6.7 millimeters as measured from a centerline of the adjacent holes;

wherein adjacent rows of holes are substantially equally spaced; and wherein adjacent rows of holes are spaced between 3.8 millimeters and 4 millimeters inclusive as measured from the centerlines of adjacent rows of holes.

7. The armband of claim 1, wherein the diameters of the holes are substantially the same.

8. The armband of claim 1, wherein the diameter of the holes is between 1.5 millimeters and 3.5 millimeters inclusive.

9. The armband of claim 1, wherein the loop cells are oval.

10. The armband of claim 1, wherein the loops cells are located on the arm strap so that the hook cell can overlap at least two adjacent loop cells.

11. The armband of claim 1, wherein the window is bonded to the pouch using an adhesive, heat, and pressure.

12. The armband of claim 1, wherein the window includes:

a substantially transparent portion; and a substantially translucent portion;

wherein the substantially translucent portion of the window is formed by applying an ink to a portion of an outer surface of the window; and wherein the ink is formulated so that the ink provides:

a frosty and translucent appearance; and a low-friction scrolling surface for a finger.

13. The armband of claim 12, wherein the window includes a button area which is configured to facilitate locating a button on the electronic device;

wherein the button area is located within the translucent portion of the window;

wherein the button area protrudes out of-plane from the outer surface of the window;

wherein the button area is formed using a hydroforming process which presses the window into a desired shape; and wherein the button area is formed after ink is applied to the window.

14. The armband of claim 1, further comprising a polyurethane microfiber material for an inner lining of the pouch.

15. The armband of claim 1, wherein the arm strap and the first face of the pouch are made from a single piece of material; and wherein the first face of the pouch and a second face of the pouch are bonded together along the edges of the pouch.

16. The armband of claim 15, wherein a bond is created using an adhesive, heat, and pressure applied at the edges of the pouch.

17. The armband of claim 16, wherein the adhesive is a urethane-based adhesive.

18. The armband of claim 15, wherein a hole is cut into the second face of the pouch to create the opening in the pouch, wherein the hole is located away from the edge of the second face.

19. The armband of claim 15, further comprising stitches at a junction of the arm strap and the pouch to reinforce the coupling between the arm strap and the pouch.

20. The armband of claim 15, further comprising stitches at a junction of the ring and the pouch to reinforce the coupling between the ring and the pouch.

21. The armband of claim 1, wherein the holes are punched into the arm strap after the loop cells are coupled to the arm strap.

22. The armband of claim 1, further comprising:

a storage-mode cell located on a face of the arm strap opposite to the face of the arm strap in which the plurality of loop cells and the hook cell are located, wherein the storage-mode cell is configured so that when the arm strap is wrapped around the pouch, the hook cell can be coupled to the storage-mode cell to prevent the hook cell from attaching to other materials.

23. The armband of claim 22, wherein the face of the arm strap opposite to the face of the arm strap in which the plurality of loop cells and the hook cell are located does not include hook cells.

24. An armband for holding an electronic device, comprising:

a pouch constructed to hold an electronic device;

a window on a first face of the pouch, comprising one or more button areas configured to facilitate locating buttons on the electronic device; and an arm strap having a proximate end coupled to a second edge of the pouch, wherein the arm strap comprises a layer of spandex sandwiched between two layers of polyurethane, and wherein the arm strap further comprises:

a plurality of loop cells at specified locations along the length of the arm strap;

a hook cell located at a distal end of the arm strap.

25. The armband of claim 24, further comprising:

a storage-mode cell located on a face of the arm strap opposite to the face of the arm strap in which the plurality of loop cells and the hook cell are located, wherein the storage-mode cell is configured so that when the arm strap is wrapped around the pouch, the hook cell can be coupled to the storage-mode cell to prevent the hook cell from attaching to other materials.

26. An armband for holding an electronic device, comprising:

a pouch constructed to hold an electronic device;

an arm strap coupled to the pouch, the arm strap constructed to couple the pouch to an arm; and a window on a face of the pouch, wherein the window comprises one or more button areas configured to facilitate locating one or more buttons on the electronic device;

wherein the arm strap comprises a layer of spandex sandwiched between two layers of polyurethane.

27. An armband for holding an electronic device, comprising:

a pouch with a first face and a second face;

a window on the first face of the pouch, wherein the window includes a translucent portion;

a button area in the translucent portion of the window, wherein the button area comprises a protrusion that protrudes out of-plane from an outer surface of the window;

an opening located along a first edge of the second face of the pouch, wherein the opening is configured to allow an electronic device to be inserted into the pouch;

an arm strap having a proximate end coupled to a second edge of the pouch, wherein the arm strap comprises a layer of spandex sandwiched between two layers of polyurethane, and wherein the arm strap further comprises:

a plurality of holes arranged in a specified pattern;

a plurality of loop cells at specified locations along the length of the arm strap; and a hook cell located at a distal end of the arm strap; and a ring coupled to a third edge of the pouch, wherein the ring is configured to allow the distal end of the arm strap to be passed through the ring and pulled toward the proximate end of the arm strap so that the hook cell can be coupled to one or more loop cells.

28. The armband of claim 27, wherein the button area is formed in the window using a hydroforming process.

29. The armband of claim 27, wherein the translucent portion of the window is formed by applying an ink to a portion of an outer surface of the window, and wherein the button area is formed after ink is applied to the window.

* * * * *